US008801530B2

(12) United States Patent
Beck et al.

(10) Patent No.: US 8,801,530 B2
(45) Date of Patent: Aug. 12, 2014

(54) GRIP GUIDE APPARATUS AND METHOD OF USING THE SAME

(75) Inventors: Karen Beck, Lake Forest, IL (US); Chip Beck, Lake Forest, IL (US)

(73) Assignee: B 10 LLC, Lake Forest, IL (US)

( * ) Notice: Subject to any disclaimer, the term of this patent is extended or adjusted under 35 U.S.C. 154(b) by 146 days.

(21) Appl. No.: 13/365,934

(22) Filed: Feb. 3, 2012

(65) Prior Publication Data

US 2012/0295723 A1 Nov. 22, 2012

Related U.S. Application Data

(60) Provisional application No. 61/439,383, filed on Feb. 4, 2011, provisional application No. 61/525,474, filed on Aug. 19, 2011.

(51) Int. Cl.
*A63B 69/36* (2006.01)

(52) U.S. Cl.
USPC ..... 473/201; 473/205

(58) Field of Classification Search
CPC ..... A63B 59/0014
USPC ..... 473/131, 202, 203, 204, 282, 300, 303
See application file for complete search history.

(56) References Cited

U.S. PATENT DOCUMENTS 4,138,118 A * 2/1979 Budney ..... 473/202
5,223,958 A * 6/1993 Berry ..... 349/20
5,419,563 A * 5/1995 Abrams et al. ..... 473/202
5,542,676 A * 8/1996 Howe et al. ..... 473/202
6,941,818 B2 * 9/2005 Rakowski ..... 73/762
7,241,237 B2 * 7/2007 Iggulden ..... 473/606
7,537,525 B2 5/2009 Wang
2009/0137336 A1 5/2009 Hsu et al.
2009/0170641 A1 7/2009 Qin et al.
2010/0184530 A1 7/2010 Johnson
2011/0212790 A1 * 9/2011 Webb ..... 473/202

OTHER PUBLICATIONS

International Search Report and Written Opinion issued in connection with PCT/US2012/023825, dated May 25, 2012. 8 pages.

* cited by examiner

*Primary Examiner* — Nini Legesse
(74) *Attorney, Agent, or Firm* — Vedder Price P.C.

(57) ABSTRACT

A grip guide apparatus is disclosed for use as a training aid. The grip guide apparatus includes a substrate and chromic material. The substrate is dimensioned to cover at least a portion of an article of sports equipment such as a handle. The chromic material is capable of changing colors in response to one or more external stimuli. Changes in color of chromic material thereby indicate whether the user has proper or improper hand placement on the article of sports equipment. The chromic material may also indicate whether the user has applied the proper or improper amount of pressure to the article of sports equipment. The substrate may include an adhesive backing to affix the grip guide apparatus to the article of sports equipment. By generating feedback from the chromic material, good habits can be formed with respect to taking a proper grip of the article of sports equipment.

11 Claims, 5 Drawing Sheets

1

300

GRIP GUIDE APPARATUS AND METHOD OF USING THE SAME

CROSS-REFERENCE TO RELATED APPLICATIONS

This application claims the benefit of U.S. Provisional Application No. 61/439,383, filed Feb. 4, 2011 and U.S. Provisional Application No. 61/525,474, filed Aug. 19, 2011.

FIELD OF DISCLOSURE

This disclosure relates to a guide for properly gripping sports equipment. More specifically, it relates to a material that is placed on sports equipment to aid in proper hand or grip placement.

BACKGROUND

When using sports equipment, such as a golf club, tennis racquet, baseball bat, etc., one of the most fundamental aspects of the sport is the correct placement of one's hand(s) on and the amount of pressure applied the equipment (e.g., the handle). While hand placement and the amount of pressure are two of the most fundamental aspects of any sport, they are also two of the most difficult to properly achieve because they are often overlooked and under-practiced by players. The proper hand placement and pressure on the handle or grip of sports equipment can greatly increase one's chances at being a better player, but bad habits are easy to develop and hard to break. Therefore a variety of guides and devices have been developed to assist both beginners and experienced players with improving proper hand placement and pressure.

Since proper hand placement and pressure are important, countless books have been written and videos have been produced showing a player how to properly grip the handle in question. A player can read or view the books and/or videos and mimic the proper hand placement and pressure as described or otherwise illustrated in the book or video. While this can be a successful approach, one problem is that the player does not have any feedback as to whether he/she has followed the directions and has actually achieved proper hand placement and pressure. Because of this, there is room for error. Continuously practicing with the wrong grip reinforces bad habits of an improper grip.

Another option, especially for beginners at a sport, is to be personally instructed by an instructor as to the proper hand placement on sports equipment. This method is very useful as the instructor can instantly correct any errors and help the player achieve proper hand placement on the equipment. However, the drawback to this approach is that the instructor is typically only with the player for a short period of time. When not with the instructor, it is easy for a player to forget proper hand placement and fall back on a more comfortable and improper grip.

Because of the above-mentioned drawbacks, many devices have been developed to help a player achieve proper hand placement on the sports equipment. One such example is described in U.S. Pat. No. 7,537,525 (the "'525 patent"). The '525 patent relates to a method of training a golfer how to correctly place his/her hands on a club by sliding a training device over the handle of a golf club and using lasers to properly position the training device on the handle. A drawback to this invention is that it can be difficult for players to position the device on the club handle, the device is bulky and draws attention to itself and the device does not feel natural. Another development to aid in proper hand placement is the use of specialized gloves that have bars or bumps along the inside of the hand to indicate where player's hands should be placed. Similar to the '525 patent, the downfall to such devices is that they tend to be expensive, bulky or heavy and draw attention to the fact that a player is using a training aid. None of the prior art devices provide a natural feel.

This disclosure solves the above-mentioned problems by providing an inexpensive, simple training aid for players to improve their hand placement and/or amount of pressure applied to sports equipment (e.g., a handle) with instant feedback as to whether or not the hands are positioned accurately and the pressure is proper. As will be appreciated by one of skill in the art, the training aid described in this disclosure provides the user a natural feel of the article of sports equipment. This and other advantages will be fully realized in more detail below.

SUMMARY

This disclosure relates to a method of training and an apparatus for use in training a user to properly grip sports equipment. The training aid is a grip guide apparatus comprising a substrate designed to be placed on article of sports equipment. In one embodiment, the substrate is sufficiently flexible yet durable to cover and wrap around at least a portion of a handle of sports equipment. In one embodiment, the substrate has an adhesive backing or other adhesive disposed on the back surface of the substrate for affixing the substrate to a handle of the article of sports equipment.

The substrate described herein may include one or more positional indicator(s) so that the user may properly align the substrate to the sports equipment. The substrate may further include one or more proper hand placement indicators disposed on or into the body of the substrate to designate proper hand placement on the article of sports equipment (e.g., the handle).

In one embodiment, the substrate further includes chromic material that is capable of changing color in response to a change in environment or external stimuli (e.g., a change in temperature, mechanical pressure, light irradiation, etc.) or the presence of another suitable stimulus and is therefore capable of providing feedback to a user based on proper or improper hand placement and/or pressure applied to the article of sports equipment. The chromic material may be confined to areas of the substrate (i.e., chromic regions) where the article of sports equipment is designed to be held by a user during normal use of the article of sports equipment. The chromic material may include inks or dyes, paints, polymers, minerals, chemical compounds or other substances that are capable of inducing one or more changes in the color of the chromic material(s) based on presence of absence external stimuli.

The induction of color change in the chromic material is preferably reversible so that the color of the material reverts back to its natural state upon removal of the external stimulus. For example, thermochromic ink or leuco dyes change color based on a change in temperature, photochromic ink changes color based on a change in light irradiation, and piezochromic ink changes color based on a change in mechanical pressure. Thermochromic inks, photochromic inks and piezochromic inks may be microencapsulated or unencapsulated and rely on unique characteristics of liquid crystals to provide the desired effect and color change to specific external stimuli.

The substrate is dimensioned (e.g., sized and/or shaped) to accommodate the shape and size of the article sports equipment with which it is intended to be used. For example, with a golf club, the substrate may be designed to wrap around or be disposed over the handle of grip of the club and the size may therefore be based on a standard size handle grip (e.g., 9.50 inches by 2.875 inches). The substrate seams may be flexible to accommodate longer and wider handles or other positions of sports equipment. It is also anticipated that the substrate be manufactured in a variety of sizes so that a player can utilize the substrate most appropriate for his/her hand size. One skilled in the art will recognize that it is possible to dispose (e.g., print) larger or smaller than standard illustrations (e.g., indicators) on the substrate. One of skill in the art will further recognize that the substrate may be trapezoidally-shaped, dress-shaped, rectangularly-shaped, or otherwise shaped to suit the needs of the sports equipment (e.g, club, racquet, glove, etc.) it is designed to accommodate.

After a player positions the substrate onto the sports equipment (e.g., a handle), he/she simply needs to align his/her hands according to the indicators (e.g., the hand placement indicators). By using the chromic material, a user will instantly receive feedback as to whether or not hand placement and/or pressure is correct. In particular, the chromic material(s) may change one or more colors indicating proper or improper hand placement and/or pressure. This allows a user to make corrections instantly to his/her grip on the sports equipment (e.g., handle), thereby improving game play. Further, the substrate is thin and discreet, allowing for use in any variety of circumstances without drawing attention to the training aid.

When equipped with an adhesive backing, the substrate may be easily affixed to an article of sporting equipment. In a preferred embodiment, the adhesive is a temporary adhesive so that the substrate may be removable and reapplied to other sporting equipment. This is particularly useful in sports such as golf where multiple clubs may be used in a given round. If the adhesive on such an adhesive backed substrate has worn off, at that time the substrate will become disposable. One skilled in the art will recognize that the adhesive backed substrate have many hours of usage depending on the type of adhesive used.

It will be appreciated by those skilled in the art that many modifications and variations (for example, changing the location of the chromic material, the type of chromic material and the application to different sports equipment) may be made to the disclosure described herein without departing from the spirit and scope of the disclosure.

DETAILED DESCRIPTION OF THE DRAWINGS

The disclosure will be more readily understood in view of the following description when accompanied by the below figures and wherein like reference numerals represent like elements:

Figure 2:
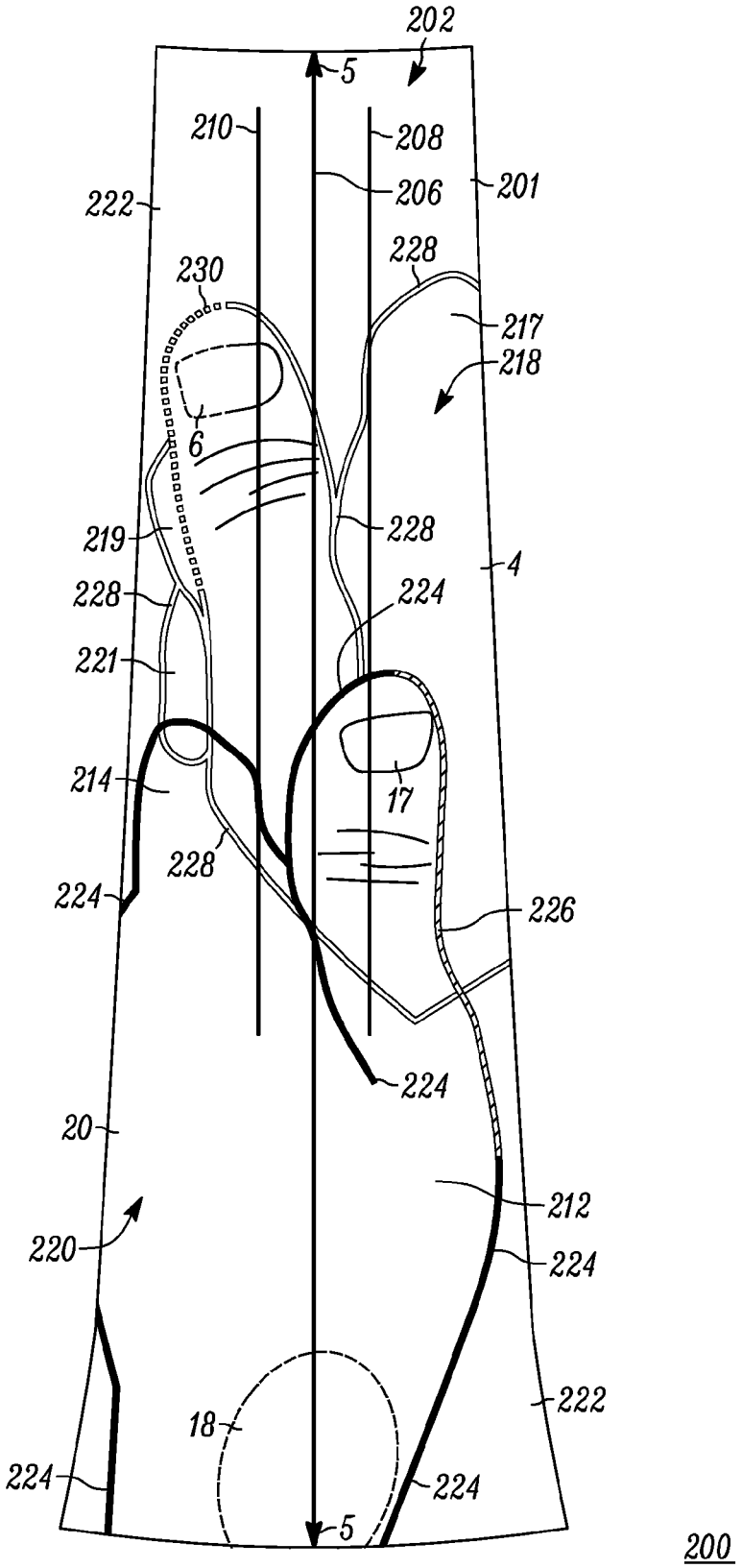
FIG. 2 depicts a grip guide apparatus in accordance with a second embodiment of the disclosure having a substrate, positional indicators, hand placement indicators and guideline indicators on a front surface of the substrate indicating the correct right-hand grip for a golf club.
Figure 4:
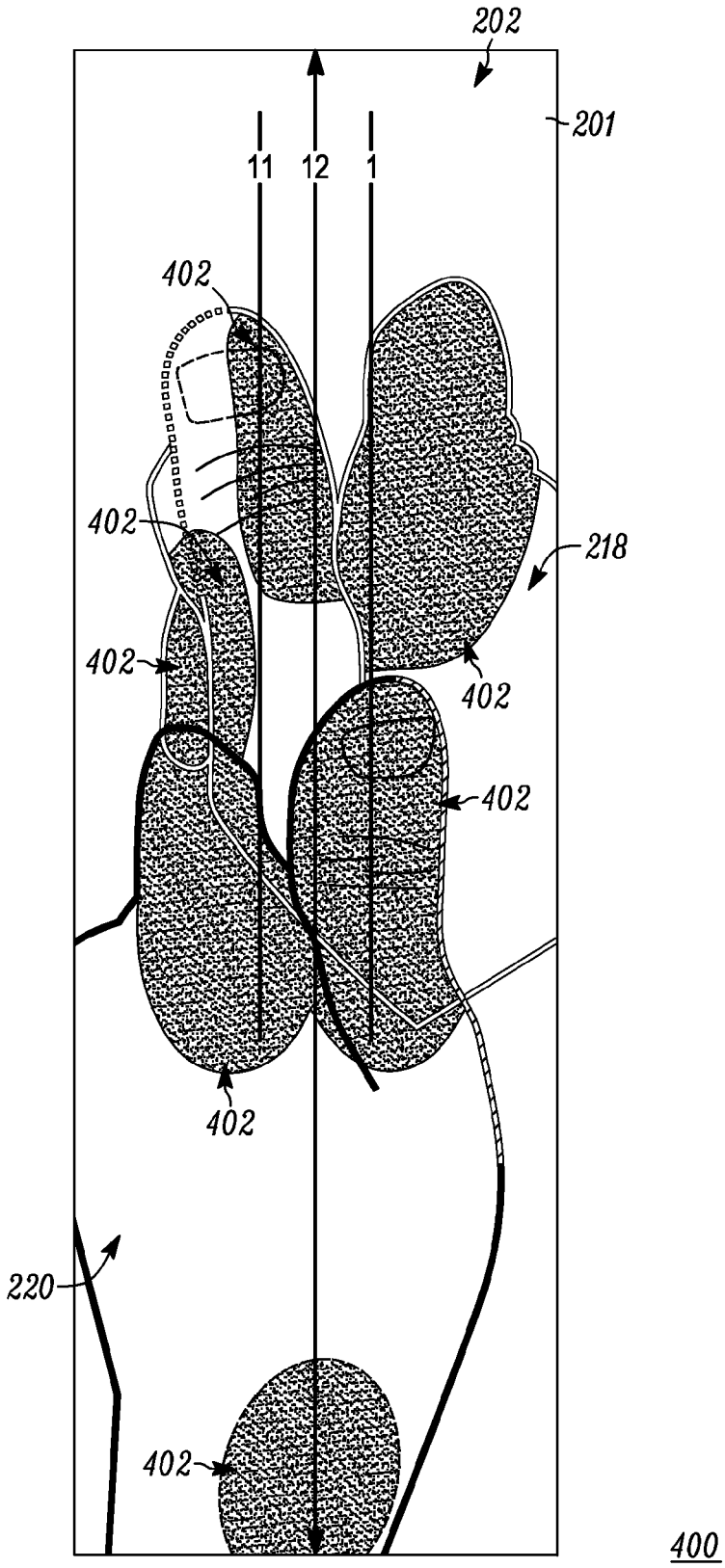
Figure 5:
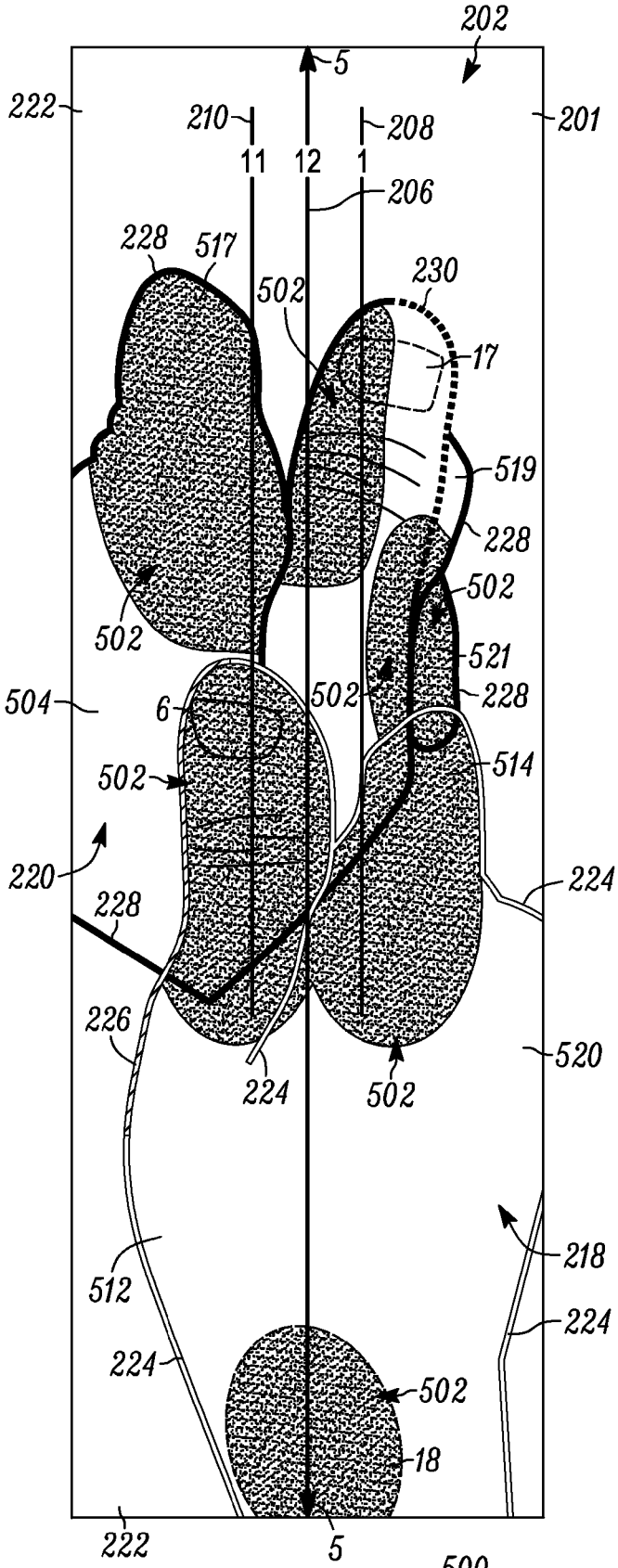

FIG. 4 depicts the grip guide apparatus of FIG. 2 further illustrating chromic material contained within alternate chromic regions in accordance with a fourth embodiment of the disclosure; and FIG. 5 depicts a grip guide apparatus in accordance with a fifth embodiment of the disclosure having a substrate including chromic regions, positional indicators, hand placement indicators and guideline indicators on a front surface of the substrate indicating the correct left-hand grip for a golf club.

DETAILED DESCRIPTION OF THE PREFERRED EMBODIMENT

Preferred features of the present disclosure will now be described with particular reference to the accompanying drawings. However, it is to be understood that the features illustrated in and described with reference to the drawings are not to be construed as limiting on the scope of the disclosure. As one of ordinary skill in the art will readily appreciate, the drawings are described in reference to a golf club and, more particularly, to a grip or handle for a golf club. However, the drawings equally apply to other types of sports equipment. The grip guide apparatus may not only be applied to clubs, racquets, fencing swords, lacrosse sticks, hockey sticks, etc., but it may also be applied to gloves (and mitts), socks, sleeves, and other materials such as leather, synthetic leather, textile, etc.

Figure 1:
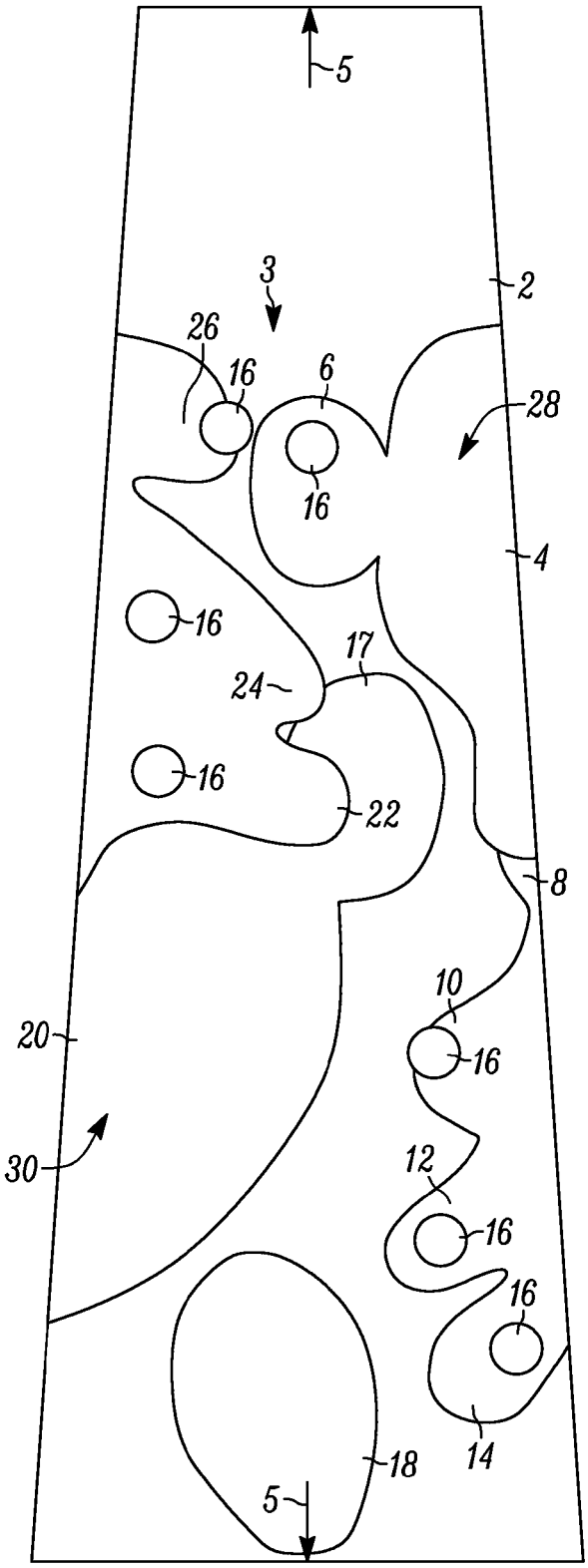
FIG. 1 depicts a grip guide apparatus in accordance with a first embodiment of the disclosure having a substrate including chromic regions, positional indicators and hand placement indicators on a front surface of the substrate indicating the correct right-hand grip for a golf club.

FIG. 1 depicts a grip guide apparatus 1 in accordance with a first embodiment of the disclosure having a substrate 2 including chromic regions 16 comprising positional indicators 5 and hand placement indicators 28, 30 for the right hand and the left hand on the front side surface of the substrate. Chronic regions 3, positional indicators 5 and hand placement indicators 28, 30 are disposed on or into substrate 2 (e.g., by printing) at the front surface 3 thereof. In the example of FIG. 1, right hand placement indicators 28 may include indicators for the palm of right hand 4, right thumb 6, right ring finger 22, right middle finger 24, and right index finger 26 as described below. Similarly, left hand placement indicators 30 may include indicators for left index finger 8, left middle finger 10, left ring finger 12, left pinky (or little) finger 14, left thumb 17, left heel pad 18 and left palm 20 as discussed below.

In the example illustrated, grip guide apparatus 1 is dimensioned to cover at least a portion of a golf club and, in particular, a handle or "grip" of a golf club. More particularly, the grip guide apparatus 1 indicates the correct right-hand grip for a golf club. One of skill in the art will recognize that a grip guide apparatus similar to the grip guide apparatus 1 of FIG. 1 may be used with different articles of sports equipment. As such. the grip guide apparatus 1 may be dimensioned to cover at least a portion of any article of sports equipment. The article of sports equipment may include, for example, a golf club, a baseball bat, a softball bat, a racquetball racket, a tennis racquet, a squash racquet, a badminton racquet, a cricket club, a croquet club, a hockey stick, a lacrosse stick, a fencing sword, a golf glove, a baseball glove, a softball glove, a racquetball glove, a tennis glove and a badminton glove.

In one embodiment, substrate 2 comprises a printable substrate such as a fabric, film, laminate, plastic or other material. In one embodiment, substrate 2 may be a woven polyester coated with urethane on both sides. As such, the chronic regions 16, positional indicators 5, and hand placement indicators 28 and 20 may appear as an "illustration" disposed on or onto the substrate 2. The grip guide apparatus 1 may further include an adhesive disposed on a back surface of the substrate 2 (not illustrated) so that the grip guide apparatus 1 may be secured to the article of sports equipment. Such an adhesive may take the form of an adhesive backing. The adhesive backing may include a protective strip that must be peeled away to protect the adhesive prior to usage. The adhesive used may be of a permanent type or a temporary type to disallow or allow the removal of the grip guide apparatus 1 from the article of sports equipment (e.g., golf club). For example, the adhesive may be any known substance commonly used on stickers and the like. Alternatively, fasteners may be used to secure the grip guide apparatus 1 to the article of sports equipment such as various ties, rope, string, tacks, screws, hook and loop fasteners (e.g., Velcro®), glue, etc. Substrate 2 may also be manufactured in the shape of a tube and shrunk to fit the shape of a handle or other article of sports equipment (e.g., using heat). It is recognized, however, that substrate 2 need not include any such adhesive or fastener to secure the grip guide apparatus 1 to the article of sports equipment and that the substrate 2 need not necessarily be secured to the article of sports equipment to use the grip guide apparatus 1.

Substrate 2 is preferably flexible to cover and wrap around or be disposed over at least a portion of an article of sports equipment (e.g., a handle of a golf club). The substrate 2 is preferably durable to be used multiple times with several clubs without tearing.

In the example of FIG. 1, hand placement indicators 28 and 30 designate positions of the proper grip that a right-handed golfer should use when holding a golf club. Placement of the right hand is generally at the position associated with the hand placement indicator 28 and placement of the left hand is generally at the position associated with the hand placement indicator 30. The right hand position indicators 28 and the left hand position indicators 30 on illustration 3 may be designated by an outline of said right hand and left hand positions, or by one or more other visual indicators such as various colors, patterns, etc. One skilled in the art will readily appreciate that a similar illustration or demarcation could be used on substrate 2 to illustrate proper grip position for a left-handed golfer (i.e., with the right hand of the golfer located farthest from the club face and with fingers of the right hand wrapping from the right side to the left side of the club opposite to that depicted in FIG. 1 with respect to the left hand and with the left hand of the golfer located closest to the club face and generally on top of the right hand with fingers of the left hand wrapping from the left side of to the right side the club opposite to that depicted in FIG. 1 with respect to the right hand).

When a user desires to use the grip guide apparatus 1 on a golf club (not depicted), he or she aligns and wraps the substrate 2 around or otherwise disposes the substrate 2 over the golf club handle (not depicted) and affixes the same to the handle using any suitable fastener. It is recognized that the substrate 2 may take alternate forms and be otherwise disposed over or on top of an article of sports equipment. For example, in the context of a golf club, substrate 2 may be formed in the shape of a tube and heat shrunk to the golf club handle. Preferably, substrate 2 is an adhesive backed substrate 2, in which case, the user may simply remove any protective strip covering the adhesive backing (not depicted) prior to aligning and wrapping the substrate 2 around the handle.

In one embodiment, the grip guide apparatus 1 includes positional indicators 5 wherein the one or more positional indicators 5 designate how to properly align the substrate 2 and thus the grip guide apparatus 1 with respect to the article of sports equipment. In the example of FIG. 1, the positional indicators 5 are arrows located at the bottom and top of the substrate 2. One of ordinary skill in the art will appreciate that when the heel of a golf club is rested on the ground, the natural position of the club is with the sloped club face generally perpendicular to a given target. Naturally, the slope of any club is related to the desired loft associated with ball flight when the ball is properly struck by the club. Notwithstanding the variance of club face slope across a given set of golf clubs, the face of each such club is generally considered perpendicular to a target when at rest. When in such a position, the substrate 2 should be applied to the grip of a golf club such that the 12:00 o'clock line formed by connecting the ends of the arrows 5 extends down the shaft of the club (not illustrated) and runs parallel to the club face. For example, The right side (i.e., the 1:00 o'clock side) of front surface 3 relative to the 12:00 o'clock line includes several hand placement indicators illustrating the proper hand placement for the palm of the right hand 4, right thumb 6, left index finger 8, left middle finger 10, left ring finger 12, left pinky (or little) finger 14 and left thumb 17. Along the bottom of the front surface 3 is a hand placement indicator or guide for the heel pad of the left hand 18 (i.e., the proximate portion of the thenar eminence). The left side (i.e., the 11:00 o'clock side) of front surface 3 relative to the 12:00 o'clock line includes hand placement indicators for the palm of the left hand 20, right ring finger 22, right middle finger 24, and right index finger 26.

The grip guide apparatus 1 further includes chromic regions 16 containing chromic material such as inks, dyes, paints, polymers, minerals, chemical compounds or other substances that are capable of inducing one or more changes in the color of the chromic material(s) based on presence of absence external stimuli. For example, thermochromic material such as ink or leuco dyes change color based on a change in temperature, photochromic material such as ink changes color based on a change in light irradiation, and piezochromic material such as ink changes color based on a change in mechanical pressure. Thermochromic inks, photochromic inks and piezochromic inks may be microencapsulated or unencapsulated and rely on unique characteristics of liquid crystals to provide the desired effect and color change to specific external stimuli. Preferably, the change in color associated with the chromic material is temporary to permit the grip guide apparatus 1 to be used multiple times by the user without having to replace the grip guide apparatus 1 after each use. It is recognized, however, that the change in color may be permanent.

One of skill in the art will recognize that the chromic material may be disposed on or into the substrate 2 using known techniques such as silk screen printing, flexographic printing and pad or temp printing. Other processes are also contemplated so long as the chromic material is capable of reacting to the predetermined stimuli to which it is customarily used and capable of changing color(s) and thereby providing visual feedback to a user.

When in use on an article of sports equipment such as a golf club handle and when a user's hands are properly placed over the grip guide apparatus 1, those chromic regions 16 will change color by the presence or absence of heat, light, or mechanical pressure or other external stimuli. It is conceived that the entire substrate 2 may include chromic materials and therefore constitute one or more chromic regions. Alternatively, it is conceived that chromic materials may limited to those portions of the substrate 2 where a user's hand will apply suitable coverage and/or pressure over the illustration 3 when the grip guide apparatus 1 is applied to a golf handle and when the user grips said handle. In other words, chromic regions 16 may correspond only to areas where the article of sports equipment is designed to be held by a user during normal use of the article of sports equipment. When the substrate 2 is applied to a golf club grip, these chromic regions 16 may indicate whether or not a user's grip is too tight or not tight enough by changing color. Alternatively, chromic regions 16 may simply react to temperature or lack of ambient light, thereby indicating that a user's hands are correctly griping the handle of the club.

It is further recognized that the chromic material used in the grip guide apparatus 1 may be of multiple types to permit changes in color to multiple predetermined stimuli instead of simply one predetermined stimuli. For example, the grip guide apparatus 1 may include chromic material of a first type (e.g., thermochromic ink) capable of changing color in response to temperature changes and chromic material of a second type (e.g., piezochromic ink) capable of changing color in response to mechanical pressure changes. In another example, the grip guide apparatus 1 may include chromic material capable of changing color in response to the same type of stimulus where the color expressed or displayed by the chromic material is a function of the amount of the stimulus observed. For example, the grip guide apparatus 1 may include chromic material capable of changing to a first color based on a first predetermined amount of temperature and other chromic material capable of changing to a second color based on a second predetermined amount of color. In yet another embodiment, the chromic material used is capable of expressing or displaying more than one color based on the stimuli observed. Combinations of the foregoing are also contemplated and within the scope of this disclosure.

Each of the positional indicators 5, the hand placement indicators 28, 30 and chromic material 16 are directly or indirectly applied to or otherwise disposed on or onto the substrate 2. In one embodiment, such indicators and material take the form of the an illustration. It is further recognized that grip guide apparatus 1 may be formed from one or more layers or directly attached to or disposed on or into the substrate 2.

It is further recognized that the hand placement indicators 28, 30 and the positional indicators 5 may take any suitable form such as ink, puffy ink, chromic material, additional substrate material and an etching disposed on or into the substrate 2 and may be applied to or disposed on or into the front surface 3 of the substrate 2 by a conventional process such as printing, application by laser, sowing, embossing, screening, etc. One skilled in the art will recognize that there are a wide variety of means of applying such indicators to the substrate 2. As such, the hand placement indicators 28, 30 and positional indicators 5 may be capable of providing a tactile response or stimulus to the user of the grip guide apparatus 1. In one embodiment, both the hand placement indicators 28, 30 and the positional indicators 5 comprise an ink disposed on to the substrate 2.

Figure 3:
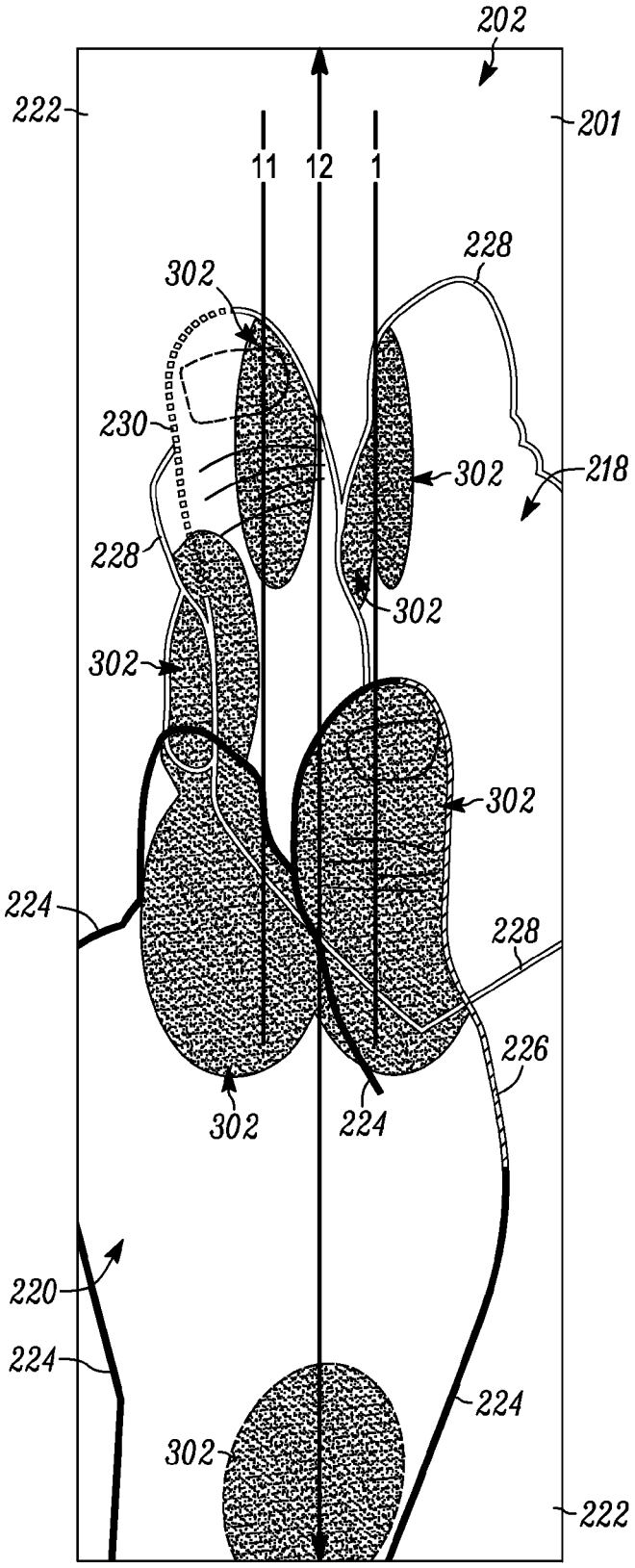
FIG. 3 depicts the grip guide apparatus of FIG. 2 further illustrating chromic material contained within chromic regions in accordance with a third embodiment of the disclosure.

FIG. 2 depicts a grip guide apparatus 200 in accordance with a second embodiment of the disclosure having a substrate 201, positional indicators 5, hand placement indicators 218 and 220 and guideline indicators 206-210 on the front surface 201 of the substrate 201 indicating the correct right-hand grip for a golf club. FIGS. 3-4 depict the grip guide apparatus 300, 400 that are to identical (but in shape) to the grip guide apparatus 1 of FIG. 1 and illustrate exemplary chromic regions 302 and 402. One of skill in the art will further recognize that grip guide apparatus 200, 300, 400 may take on other dimensions, including other dimensions to fit other articles of sports equipment, and may customized to have chromic regions disposed elsewhere on substrate 201.

Substrate 201, positional indicators 5, hand placement indicators 218 and 220 and guideline indicators 206-210 may be of the same or similar construction as like-named components of the grip guide apparatus 1 of FIG. 1. The elements of the grip guide apparatus 200 are assigned new reference numerals to indicate a new layout or position of the elements on the underlying substrate 201 in accordance with a second embodiment of the disclosure. One of skill in the art will recognize that the grip guide apparatus 200 may be applied to a golf club in the same manner as the grip guide apparatus 1 described above. As further described below, right hand placement indicator 218 may include indicators for the palm of right hand 4, right thumb 6, right index finger proximal flange 217, right middle finger middle and distal flanges 219, right ring finger middle and distal flanges 221, gripping region 228 and non-gripping region 230. Similarly, left hand placement indicator 220 may include indicators for the left thumb 17, left heel pad 18, left palm 20, left thumb pad 212, left index finger proximal flange 214, non-overlapping region 224 and overlapping region 226.

Substrate 201 optionally includes adhesive disposed on a back surface of the substrate 201 (e.g., an adhesive back). A protective strip or strips may be used to protect the optional adhesive on the back side of the substrate 201. Hand placement indicators 218 and 220, like hand placement indicators 28 and 30 may be disposed on or into the substrate 201 and designate proper hand placement for at least one handle on a handle of an article of sports equipment (e.g., a golf club). FIG. 2 illustrates hand placement indicators 218 and 220 for a right-handed golf grip. FIG. 5 illustrates hand placement indicators for a left-handed golf grip. One of skill in the art will readily appreciate that a left-handed golf grip is the opposite of the right-handed golf grip (e.g., the right hand of the golfer located farthest from the club face and the left hand of the golfer located closest to the club face and generally on top of the right hand).

In one embodiment, grip guide apparatus 200 is intended to be wrapped around or disposed over the golf club handle or grip (not illustrated) using the adhesive located on the back of the substrate 201 (if present) or other suitable fastener or adhesive and the placement indicators 5. Guideline indicators 206-210 include the 12:00 o'clock line or center guideline indicator 206 formed by the ends of arrow 5, the 1:00 o'clock line or right guideline indicator 208 and the 11 o'clock line or left guideline indicator 210. The guideline indicators 206-210 may serve two purposes: (1) to help ensure that the substrate 201 and thus grip guide apparatus 200 is being affixed to the article of sports equipment in a straight and true manner; and (2) to ensure that the user of the article of sports equipment has proper hand placement.

In one embodiment, 12:00 o'clock line 206, 11:00 o'clock line 208 and 1:00 o'clock line 210 and are ribbed, raised or recessed (e.g., etched) relative to the remaining portions of the substrate 201. Guideline indicators 206-210 may be made using, for example, a puffy ink or other suitable material to provide a suitable sensation or tactile response to the user's hands indicating the presence of such guideline indicators 206-210. As such, guideline indicators 206-210 may serve as "pressure point" lines that may be felt by the user during the gripping process described below. In another embodiment, such guideline indicators do not provide any such sensation to the user and are coextensive in height with the remaining portions of substrate 201 and comprise ink, paint, etc. As further explained, regardless of the construction, guideline indicators 206-210, may aid in proper hand placement.

As one of ordinary skill in the art will appreciate, when a right handed golfer properly grips a golf club, the user's left hand 220 is generally placed on the club grip first. After proper placement of left hand 220, the user places his or her right hand 218 on the club grip. One of skill in the art, however, will appreciate that a user could grip the club in reverse order or with both hands simultaneously. Left hand placement indicators 220 illustrates the appropriate position for the left thumb 17, the left thumb pad (i.e., the distal portion of the thenar eminence) 212, the left heel pad (i.e., the proximate portion of the thenar eminence) 18, the left palm 20 and the left index finger proximal flange 214. One of skill in the art will appreciate that the remaining fingers of the left hand 220 should be wrapped around the club grip in a comfortable position; provided, however, that if the user adopts an interlock grip, the left index finger (not illustrated) will interlock with the right pinky or little finger (not illustrated) as discussed below in more detail. Similarly, right hand placement indicator 218 indicates the proper placement of the right thumb 6, the right index finger proximal flange 217, the right middle finger middle and distal flanges 219, the right ring finger middle and distal flanges 221 and the right hand palm 4. One of skill in the art will appreciate that the right index finger distal and middle flanges (not illustrated) should wrap comfortably around the club grip and that the right pinky or little finger (not illustrated) should be interlocked with or overlap the left index finger (not illustrated) in a comfortable position.

As described above, hand placement indicators 218, 220 depicting proper placement of the user's left and right hands when the substrate 201 is properly applied to a golf club grip. In one embodiment, substrate 201 may include a background indication 222 separate and apart from the remainder of the indicators disposed on or onto substrate 201. The background indicator 222 may be depicted in a first color (e.g., black). In one embodiment, the left hand placement indicator 220 further comprises two regions: a non-overlapping region 224 and an overlapping region 226. Non-overlapping region 224 corresponds to that portion of the left hand that should not be overlapped by the right hand when properly gripping the article of sports equipment. Preferably, non-overlapped region 224 is distinguished from the remainder of the indicators (e.g., by using a second color such as green). Overlapped region 226 corresponds to that portion of the left hand that should be overlapped by the right hand when properly gripping the article of sports equipment. Preferably, non-overlapped region 224 is distinguished from the remainder of the indicators (e.g., by using a third color such as blue). In the example of FIG. 2, the overlapped region 226 should rest against or within the life line (not illustrated) of the palm 4 of the right hand when the club handle is being properly gripped by the user. The "life line" or thenar crease is defined as the line or crease of palm 4 that starts at the edge of palm 4 under the index finger and flows in an arc toward the wrist.

The right hand placement indicator 218 may also comprise two regions: a gripping region 228 and a non-gripping region 230. The gripping region 228 represents that portion of the right hand that should touch and therefore form part of the grip on the article of sports equipment. Preferably, gripping region 228 is distinguished from the remainder of the indicators (e.g., by using a fourth color such as red or orange). Non-gripping region 230 represents that portion of the right hand that should not touch and therefore not form part of the grip on the article of sports equipment. Preferably, non-gripping region 230 is distinguished from the remainder of the indicators (e.g., by using a fifth color or a dashed version of the fourth color). In the example of FIG. 2, the gripping region 228 is the entirety of the right hand with the exception of the outside edge of the right thumb 6. The outside edge of the right thumb 6 is the non-gripping region 230.

It is recognized that various other patterns, designs, colors etc. may be used to designate the left and right hand placement indicators 218, 220 including their overlapping region 226, non-overlapping region 224, gripping region 228 and non-gripping region 230.

In one embodiment, grip guide apparatus 201, like grip guide apparatus 1, includes chromic regions having chromic material such as thermochromic ink that is sensitive to temperature changes, piezochromic ink that is sensitive to mechanical pressure changes, photochromic ink that is sensitive to light irradiation changes, etc. In one embodiment, the chromic regions can be coextensive with the entire substrate 201 such that the entire front surface 202 includes chromic material. In other embodiments, chromic regions are limited to only portions of the substrate 201 such as chromic regions 302 and 402 in FIGS. 3 and 4. This may be particularly valuable to reduce cost of the overall product. The selection or designation of chromic regions may be selected on several bases including the type of sporting equipment for which the grip guide apparatus is to be applied and the cost of manufacture of such grip guide apparatus. It is recognized that such chromic regions 302 and 402 may be limited to those portions of the grip guide apparatus where a user will create sufficient environmental stimuli to cause the color of the chromic material to change and provide feedback to the user as to whether the user's grip was correct.

It is further recognized that one or more different colors of chromic materials may be used to provide different natural or rest colors and different excited or non-rest colors when stimulated by a predetermined environmental catalyst or stimulus (e.g., temperature, pressure, light, etc.). It is further recognized that certain chromic materials are capable of displaying multiple colors in response to different degrees or amounts of external stimuli. Similarly, one or more different types of chromic materials may be used to provide a change in color to more than one predetermined environmental catalyst or stimulus (e.g., temperature, pressure, light, etc.).

When the grip guide apparatus 200, 300 and 400 are applied to the grip or handle of a club and when the golfer places his or her hands on the grip guide apparatus 200, 300 and 400 such that their left and right hands are in the positions indicated by applicable indicators, the chromic regions 302, 402 will change color to provide feedback to the golfer and/or golf instructor as to whether the golfer's hands were properly positioned on the club and/or whether the golfer applied the proper amount of pressure to the club, depending on the type of chromic material used in the chromic regions 302, 402. For example, if the chromic material is purple at rest, the golfer's hands may turn the chromic regions one or more different colors or shades of one or more different colors (e.g., blue). The change in color (or lack thereof) shows the relative placement and/or pressure of the golfer's hands on the handle of the golf club. For example, a change in color or shades of color may indicate that too little or too much pressure is being applied to the handle, as the case may be.

With reference to FIGS. 2-4, when substrate 201 is placed on or over the handle of a golf club, proper golf grip for a right-handed player is established when: the middle of the left thumb 17 is placed on the 1:00 o'clock line 208; the heel pad 18 of the left hand is on top of the handle at the butt of the club or handle and generally positioned at the 12:00 o'clock to 1:00 o'clock lines 206, 208; the inside of the right thumb 6 just above the distal knuckle (i.e., at the distal flange) touches the 12:00 o'clock line 206; the outside of right thumb at region 230 should not touch the handle; the right index finger proximal flange 217 (i.e., between the proximal and middle knuckles) touches at the 1:00 o'clock line 208 thereby forming a bridge with the right thumb 6 melding them together for proper placement; the left thumb 17 is positioned in the slot formed by the life line (not illustrated) of the right hand palm 4; and the right middle finger middle and distal flanges 219 and right ring finger middle and distal flanges 221 are positioned on the handle (i.e., the right middle and ring fingers should wrap around the handle comfortably and should not interlock with or otherwise overlap any fingers of the left hand). When this proper golf grip is established, the chromic regions 302 or 402 change color according to predetermined stimuli and fewer compensations are required in the user's swing.

FIG. 5 illustrates a grip guide apparatus 500 depicting the proper placement for a left-handed golfer. One of skill in the art will recognize that the left-handed grip is essentially the reverse of the right-handed grip described in FIGS. 2-4. One of skill in the art will recognize that, in the embodiment of FIG. 5, right hand placement indicator 218 may include indicators for the right thumb 6, right heel pad 18, right palm 520, right thumb pad 512, right index finger proximal flange 514, non-overlapping region 224 and overlapping region 226. Similarly, left hand placement indicator 220 may include palm of the left hand 504, left thumb 17, left hand index finger proximal flange 517, left hand middle finger middle and distal flanges 519, left hand ring middle and distal flanges 521, a gripping region 228 and a non-gripping region 230. The grip guide apparatus 500 further includes chromic regions 502 including chromic material. The position of chromic regions 502 generally mirror the position of the chromic regions 402, but are modified to suit a proper left handed grip.

The right hand takes the position at the butt of the handle and the left hand takes the position closest to the club face. Proper golf grip for a right-handed player is established when: the middle of the right thumb 6 is placed on the 11 o'clock line 210, the heel pad 18 of the right hand is on top of the handle at the butt of the club or handle and generally positioned at the 12 o'clock to 11 o'clock lines 206, 210; the inside of the left thumb 17 just above the distal knuckle (i.e., at the distal flange) touches the 12 o'clock line 206; the outside of the left thumb at region 230 should not touch the handle; the left index finger proximal flange 517 (i.e., between the proximal and middle knuckles) touches at the 11 o'clock line 210 thereby forming a bridge with the left thumb 17 melding them together for proper placement; the right thumb 6 is positioned in the slot formed by the life line of the left hand palm 512; and the left middle finger middle and distal flanges 519 and left ring finger middle and distal flanges 521 are positioned on the handle (i.e., the left middle and ring fingers should wrap around the handle comfortably and should not interlock with or otherwise overlap any fingers of the right hand). When this proper golf grip is established, the chromic regions 502 change color according to predetermined stimuli and fewer compensations are required in the user's swing.

With respect to FIGS. 2-4, the grip guide apparatus 200-400 include a designation for heel pad 18 that is generally in the shape of an oval or egg, whose top or distal end leans toward the 1:00 o'clock line 208. Heel pad 18 of grip guide apparatus 500 is in the same shape but leans toward the 11:00 o'clock line 210.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise. Throughout the specification, the term "grip" has been used both to refer to the handle of a golf club and to the appropriate placement of a golfer's hands on the handle of the club. One of skill in the art will, by context of the specification, naturally understand this conventional usage.

The above detailed description and the examples described therein have been presented for the purposes of illustration and description only and not by limitation. It is therefore contemplated that the present disclosure cover any and all modifications, variations, or equivalents that fall in the spirit and scope of the basic underlying principles disclosed above and/or claimed herein. For example, substrates 2 and 201 be modified for use with handles or grips of any number of sport equipment including baseball bats, softball bats, racquetball rackets, tennis rackets, squash rackets, badminton rackets, cricket clubs, croquet clubs, hockey sticks, lacrosse sticks, fencing swords and gloves (or mitts) or other articles of clothing for the foregoing.

One of skill in the art will further appreciate that the substrate 2, 201 associated with a grip guide apparatus may not include each of the indicators identified above as being part of illustration 3, 202. For example, a grip guide apparatus may include one or more of the following: hand placement indicators 28, 30 and 218, 220, positional indicators 5, guideline indicators 206-210 and chromic regions 16, 302, 402, 502. It is further contemplated that the indicators and chronic regions described herein may be first applied to a label or other intermediate material where such label or intermediate material is then disposed on the substrate. As such the label or intermediate material would take the form of an illustration applied to the substrate.

What is claimed is:

1. A grip guide apparatus comprising:

a substrate dimensioned to cover at least a portion of an article of sports equipment;

at least one hand placement indicator disposed on or into the substrate, wherein the at least one hand placement indicator comprises chromic material that is capable of changing color in response to one or more external stimuli such that the at least one hand placement indicator designates proper hand placement for at least one hand on the article of sports equipment, the at least one hand placement indicator including a gripping region and a non-gripping region, the chromic material positioned in the gripping region and in the non-gripping region wherein the non-gripping region represents a portion of the at least one hand that should not touch the article of sports equipment; and a center guideline indicator wherein the center guideline indicator provides a tactile response to a user of the grip guide apparatus.

2. A grip guide apparatus comprising:

a substrate dimensioned to cover at least a portion of an article of sports equipment, wherein the substrate includes a first side that is longer than a second side;

at least one hand placement indicator disposed on or into the substrate, wherein the at least one hand placement indicator comprises chromic material that is capable of changing color in response to one or more external stimuli such that the at least one hand placement indicator designates proper hand placement for at least one hand on the article of sports equipment; and a center guideline indicator disposed on or into the substrate and positioned such that the center guideline indicator runs substantially the length of the first side of the substrate and that is substantially centered with respect to the second side of the substrate.

3. The grip guide apparatus of claim 2, wherein the grip guide apparatus further includes one or more of:

a right guideline indicator disposed on or into the substrate, wherein the right guideline indicator is located to the right of the center guideline indicator and runs parallel to the center guideline indicator; and a left guideline indicator disposed on or into the substrate, wherein the left guideline indicator is located to the left of the center guideline indicator and runs parallel to the center guideline indicator.

4. The grip guide apparatus of claim 3, wherein the center guideline indicator, the right guideline indicator and the left guideline indicator are capable of providing a tactile response to a user of the grip guide apparatus.

5. The grip guide apparatus of claim 2, wherein the center guideline indicator is capable of providing a tactile response to a user of the grip guide apparatus.

6. A grip guide apparatus comprising:

a substrate dimensioned to cover at least a portion of an article of sports equipment;

at least one hand placement indicator disposed on or into the substrate, wherein the at least one hand placement indicator comprises chromic material that is capable of changing color in response to one or more external stimuli such that the at least one hand placement indicator designates proper hand placement for at least one hand on the article of sports equipment, the at least one hand placement indicator including a gripping region and a non-gripping region, the chromic material positioned in the gripping region and in the non-gripping region wherein the non-gripping region represents a portion of the at least one hand that should not touch the article of sports equipment; and wherein the at least one hand placement indicator includes indicators for the right hand thumb, right hand index finger, the right hand middle finger, the right hand ringer finger, the right hand palm, the left hand thumb, the left hand index finger, the left hand palm, the left hand thumb pad and the left hand palm pad.

7. A grip guide apparatus comprising:

a substrate dimensioned to cover at least a portion of a handle of a golf club;

at least one hand placement indicator disposed on or into the substrate, wherein the at least one hand placement indicator comprises chromic material that is capable of changing color in response to one or more external stimuli such that the at least one hand placement indicator designates proper hand placement for at least one hand on the handle, the at least one hand placement indicator including a gripping region and a non-gripping region, the chromic material positioned in the gripping region and in the non-gripping region wherein the non-gripping region represents a portion of the at least one hand that should not touch the handle of the golf club;

an adhesive disposed on a back surface of the substrate;

one or more positional indicators disposed on or into the substrate, wherein the one or more positional indicators designates how to a properly align the substrate with respect to the handle; and one or more guideline indicators capable of providing a tactile response to a user of the grip guide apparatus.

8. A method of using a grip guide apparatus, comprising:

aligning a grip guide apparatus for placement on an article of sports equipment using a positional indicator wherein the positional indicator is raised above a surface of the grip guide apparatus; and securing the grip guide apparatus to the article of sports equipment, wherein the grip guide apparatus includes at least one hand placement indicator disposed on or into the substrate, wherein the at least one hand placement indicator comprises chromic material that is capable of changing color in response to one or more external stimuli such that the at least one hand placement indicator designates proper hand placement for at least one hand on the article of sports equipment.

9. The method of claim 8, wherein the chromic material indicates at least one of:

proper hand placement on the article of sports equipment and improper hand placement on the article of sports equipment; and a proper amount of pressure applied to the article of sports equipment and an improper amount of pressure applied to the article of sports equipment.

10. The method of claim 8, wherein the at least one hand placement indicator includes a gripping region and a non-gripping region, the chromic material positioned in the gripping region and in the non-gripping region wherein the non-gripping region represents a portion of the at least one hand that should not touch the article of sports equipment.

11. The method of claim 8, wherein:

the chromic material is one or more of: thermochromic ink, photochromic ink, piezochromic ink and a leuco dye; and the substrate comprises a printable substrate.

* * * * *